US007883000B2

(12) United States Patent
Sheffield et al.

(10) Patent No.: US 7,883,000 B2
(45) Date of Patent: Feb. 8, 2011

(54) TAMPER-RESISTANT AND LEAK-RESISTANT CONTAINER

(75) Inventors: Gregg S. Sheffield, Wooster, OH (US); Peter F. Szeles, Medina, OH (US)

(73) Assignee: International Paper Co., Memphis, TN (US)

( * ) Notice: Subject to any disclaimer, the term of this patent is extended or adjusted under 35 U.S.C. 154(b) by 304 days.

(21) Appl. No.: 12/284,414

(22) Filed: Sep. 22, 2008

(65) Prior Publication Data

US 2009/0078750 A1 Mar. 26, 2009

Related U.S. Application Data

(60) Provisional application No. 60/994,945, filed on Sep. 20, 2007.

(51) Int. Cl.
*B65D 5/468* (2006.01)
*B65D 5/02* (2006.01)
*B65D 17/28* (2006.01)

(52) U.S. Cl. ..... 229/117.16; 229/117.17; 229/117.3; 229/136; 229/242

(58) Field of Classification Search ..... 229/117.16, 229/117.17, 132, 136, 240, 242
See application file for complete search history.

(56) References Cited

U.S. PATENT DOCUMENTS

| | | | | |
|---|---|---|---|---|
| 939,825 | A | 11/1909 | Frank | |
| 1,921,150 | A * | 8/1933 | Bomberger | 229/132 |
| 2,187,304 | A * | 1/1940 | Farmer | 229/132 |
| 2,506,056 | A | 5/1950 | Bergstein | |
| 2,778,557 | A | 1/1957 | Moore | |
| 3,114,494 | A | 12/1963 | Wasyluka | |
| 3,143,275 | A | 8/1964 | Diggs | |
| 3,194,474 | A * | 7/1965 | Rumberger | 229/132 |
| 3,203,613 | A * | 8/1965 | Stowe | 229/117.17 |
| 3,208,658 | A * | 9/1965 | Membrino | 229/117.3 |
| 3,341,349 | A | 9/1967 | Feeney et al. | |
| 3,547,337 | A | 12/1970 | Pisarczuk | |
| 3,580,475 | A * | 5/1971 | Mobley | 229/117.17 |
| 3,788,538 | A | 1/1974 | Kuenzi | |
| 3,952,940 | A * | 4/1976 | Malcolm | 229/117.16 |
| 3,981,432 | A | 9/1976 | Bergstein et al. | |
| 4,037,777 | A | 7/1977 | Maughan | |
| 4,067,491 | A | 1/1978 | Leakey et al. | |
| 4,138,041 | A | 2/1979 | Capo et al. | |

(Continued)

FOREIGN PATENT DOCUMENTS

DE 8634332 U1 3/1987

(Continued)

*Primary Examiner*—Gary E Elkins
(74) *Attorney, Agent, or Firm*—Matthew M. Eslami

(57) ABSTRACT

The present invention is directed to a paperboard container having generally finger access or handhold openings forming carry handles in the end walls. The handhold openings are defined by two adjacent tapered punch-out panels aligned end-to-end and hinged at their outer ends to a respective end wall. When two adjacent tapered punch-out panels punched out they fold oppositely to one another and inwardly into the container in laterally spaced relation to one another on opposite sides of the respective openings. A tear-out panel in one end wall adjoins the associated hand hold openings and when removed forms a dispensing or pourable opening immediately below the associated hand hold openings.

10 Claims, 9 Drawing Sheets

U.S. PATENT DOCUMENTS

| | | | | | |
|---|---|---|---|---|---|
| 4,141,485 | A | * | 2/1979 | Lambert | 229/132 |
| 4,169,539 | A | * | 10/1979 | Price | 229/117.16 |
| 4,359,183 | A | | 11/1982 | Aida et al. | |
| 4,550,048 | A | | 10/1985 | Nakagawa | |
| 4,621,766 | A | * | 11/1986 | McClure | 229/117.17 |
| 4,974,773 | A | * | 12/1990 | Alexander et al. | 229/117.16 |
| 5,042,684 | A | | 8/1991 | West et al. | |
| 5,678,755 | A | | 10/1997 | Block | |
| 5,803,347 | A | | 9/1998 | Sainz et al. | |
| 5,934,502 | A | | 8/1999 | Lira | |
| 5,996,886 | A | | 12/1999 | Evert | |
| 6,505,769 | B2 | | 1/2003 | Stone | |

FOREIGN PATENT DOCUMENTS

| | | | |
|---|---|---|---|
| DE | 4125329 | C2 | 2/1993 |
| GB | 2248055 | A1 | 3/1992 |
| WO | 97/01488 | A1 | 1/1997 |
| WO | 98/21105 | A1 | 5/1998 |

* cited by examiner

TAMPER-RESISTANT AND LEAK-RESISTANT CONTAINER

FIELD OF THE INVENTION

The present invention relates generally to paperboard containers or cartons that are capable of shipping articles, such as flowable or pourable substance and more particularly, to a container that is tamper proof, easily carried by hand, and having the capability permitting the substance to be poured therefrom.

BACKGROUND OF THE INVENTION

Conventional foldable cartons are well known and are used in a variety of applications. For example, the packaging industry utilizes a vast number of cartons in which numerous products are packaged for subsequent shipment. These foldable cartons or container have been equipped with variety of carry handles to accommodate grasping by the fingers of user. Such cartons or containers are used to store a wide variety of flowable substance. One problem with these cartons or containers is that the pourable substance can spill out through the carry handles. One solution in the past has been to refrain from packing flowable substance to the top of the cartons. This can waste significant capacity in the container.

Accordingly, there is need to for a container that is tamper-resistant, leak-resistant, and is easily carried on by hands of a user.

SUMMARY OF THE INVENTION

The present invention is directed to a paperboard container having generally finger access or handhold openings forming carry handles in the end walls and is defined by two adjacent tapered punch-out panels aligned end-to-end and hinged at their outer ends to a respective end wall. When two adjacent tapered punch-out panels punched out they fold oppositely to one another and inwardly into the container in laterally spaced relation to one another on opposite sides of the respective openings. A tear-out panel in one end wall adjoins the associated hand hold openings and when removed forms a dispensing or pourable opening immediately below the associated hand hold openings.

The container further has top end wall flaps, with a first flap panel hinged to the top edge of a respective associated end wall and folded inwardly to form a partial top closure, and a second flap panel hinged to the first panel and folded at a downwardly inclined angle back beneath the first panel so that its free edge lies between the finger access opening and the dispensing opening. This angled panel extends the full width of the container and defines a shield between the contents of the container and the respective associated finger access openings. A tab on the free edge of the second panel is engaged in a slot at the bottom of the respective finger access openings to hold the shield in position. The inwardly folded punch out panels that form the finger access openings are engaged snugly between the first and second flap panels, effecting partial seals at opposite side edges of the finger access openings, and with the second flap panels prevent leakage of the container contents through the finger access openings. A further tear-out panel is located in the free edge of the second panel, and when removed forms an enlargement of the dispensing opening in the container end wall. In addition, the blank that forms the container is cut so that small lateral tabs are formed at the base of the bottom-forming flaps, and these tabs tighten up the corners of the folded container to prevent leakage of the contents through these areas.

Accordingly, one aspect of the present invention is directed to a container for shipping and dispensing flowable substance. The container comprises a plurality of side walls and bottom wall flaps that are foldably joined to bottom edges of the side walls and are folded inwardly therefrom into overlapping relationship with one another to form a bottom wall closure. Top wall flaps are foldably joined to upper edges of the side walls and are folded inwardly therefrom into overlapping relationship with one another to form a top wall closure. Cut lines are formed in an opposed pair of the side walls at respective upper edges thereof, defining first punch-out panels that are pushed inwardly to form handhold openings in the opposed pair of side walls. The top wall flaps adjacent the handhold openings are forming a ceiling for the respective handhold openings. A partition panel is extending angularly downwardly from the top wall flaps to a bottom edge of each the handhold opening to isolate flowable contents of the container from the handhold openings. Each of the partition panels is folded from the top wall flaps at locations spaced from adjacent the side walls and each having a free edge engaged in the respective handhold opening at a bottom edge thereof to retain the partition panels in position.

Additional cut lines are in one of the side walls of the opposed pair of side walls, adjoining the handhold opening below the free edge of the partition panel, defining a second punch-out panel that is pushed inwardly to form a dispensing opening. The dispensing opening is isolated from the handhold opening by the partition panel. The first punch-out panels each comprise first and second tapered panels connected together along a frangible line at their inner ends and foldably are connected at their outer ends to the respective side wall. The first and second panels are extending between the respective adjacent partition panel and the respective adjacent top wall flaps to form side walls at opposite sides of each of the handhold opening. The first pouch-out panels is also serving to hold the partition panel downwardly against a bottom edge of the handhold openings. A frangible tear line is formed in the free edge of the partition panel adjacent the dispensing opening, defining a tear-out panel in the free edge of the partition panel that can be removed to enlarge the dispensing opening.

The juncture of the two adjoining side walls and associated bottom flaps form a bottom corner, and a small laterally projecting tab is formed on a side edge of at least one of two adjacent bottom wall flaps at the juncture of the bottom wall flaps and associated side walls. The tab is squeezed into the bottom corner to tighten the corner and fill any small space that may otherwise be present at the corner, thereby preventing leakage of flowable substance through the bottom corners of the container.

Another aspect of the present invention is directed to a blank for making a container for flowable substance comprises a plurality of side wall panels that are foldably joined together along adjacent side edges. A plurality of top wall flaps are foldably joined to top edges of the side wall panels. A plurality of bottom wall flaps are foldably joined to bottom edges of the side wall panels. Adjacent side edges of the bottom wall flaps is separated from one another by a slotted relief cut extending from an outer free edge of the bottom wall flaps to adjacent but spaced from the juncture of the bottom wall flaps with the side wall panels, defining a small laterally projecting tab on a side edge of at least one of the bottom wall flaps at the juncture.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
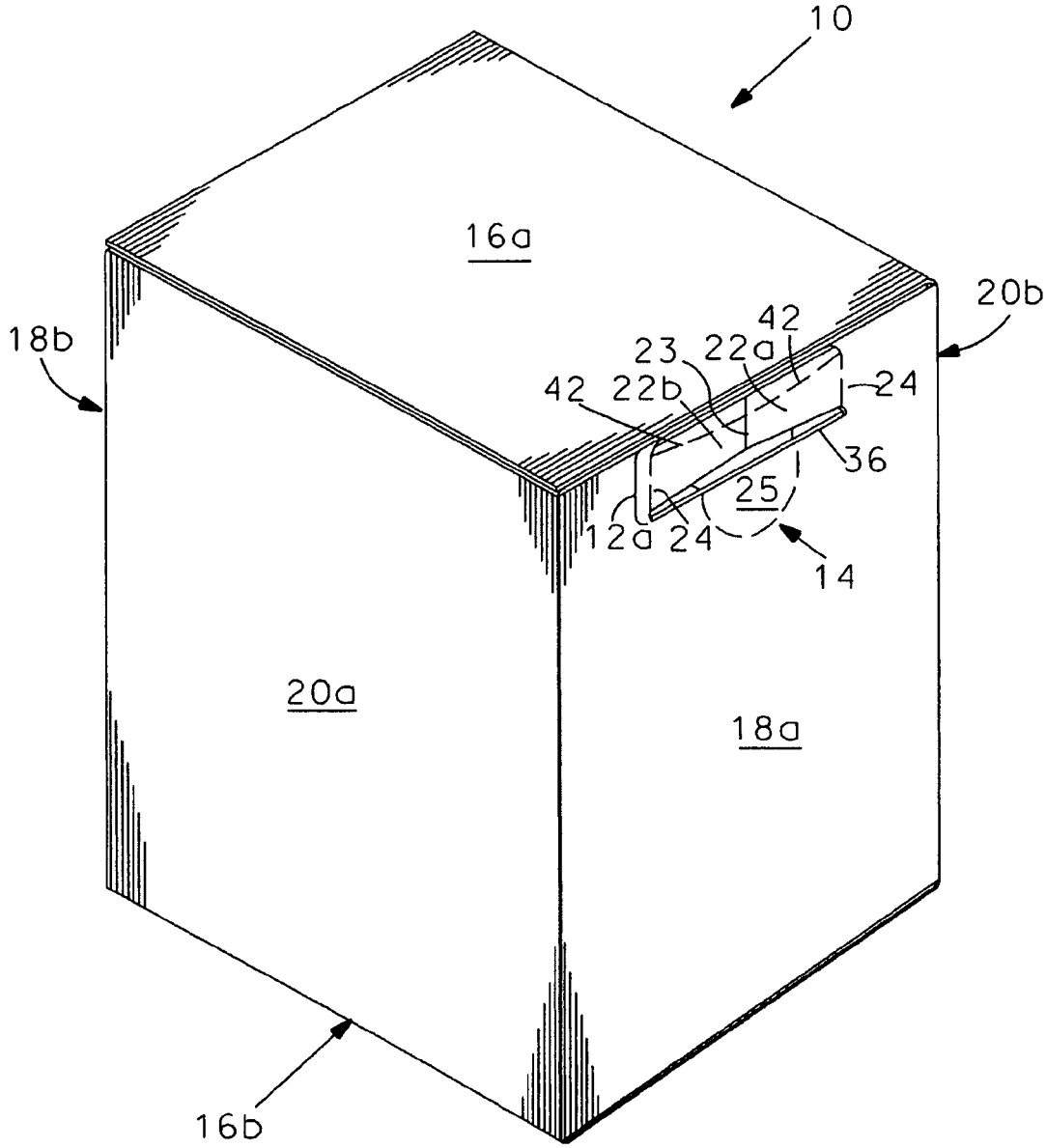
FIG. 1 is a top perspective view of a container having an integrally first handhold opening formed therein and a dispensing opening immediately below the first handhold opening in accordance to a preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 7:
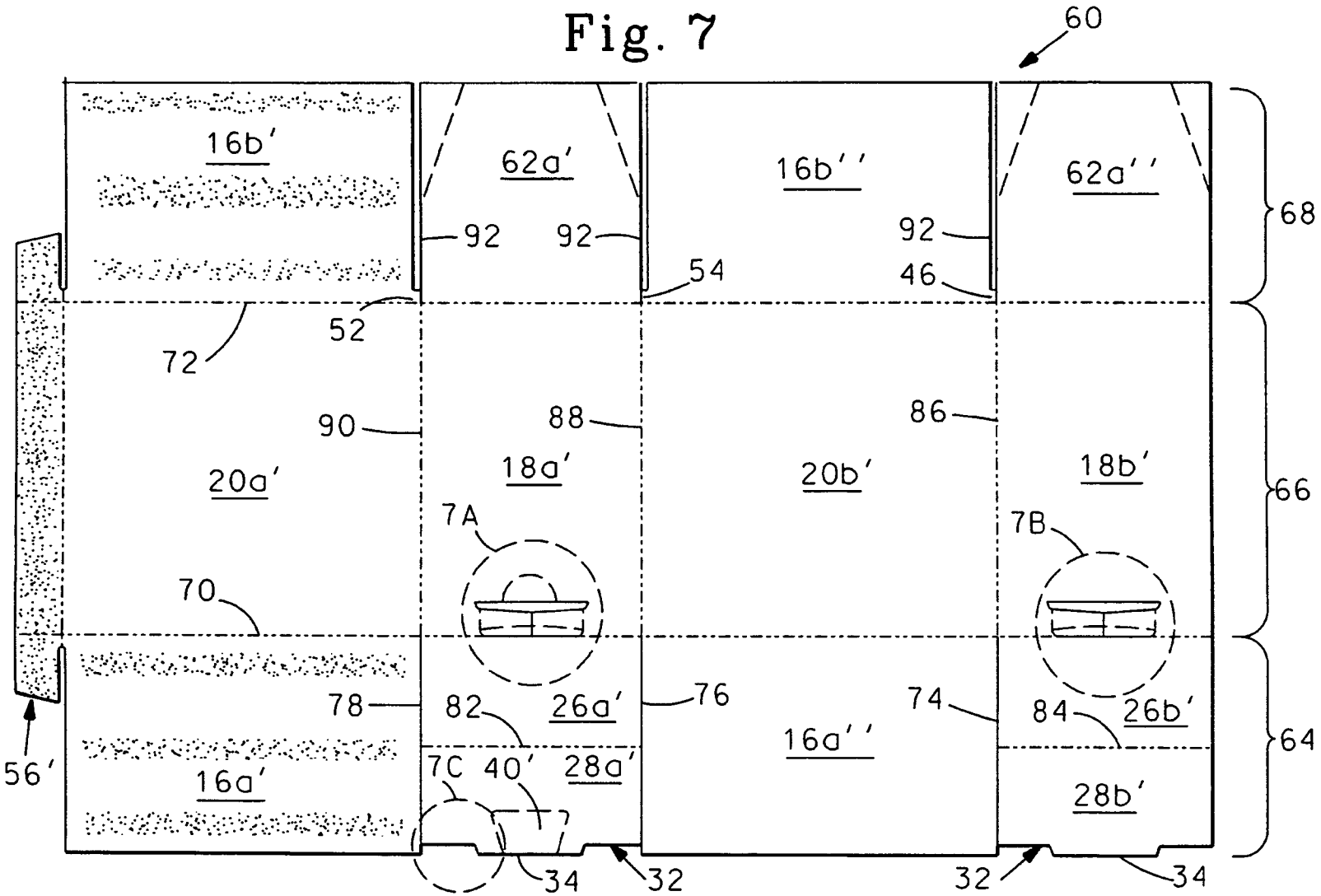
FIG. 7 is a plan view of a cut and scored paperboard blank for forming the container in FIGS. 1-4 in accordance to a preferred embodiment of the present invention.

FIG. 1 is a top perspective view of a container 10 having an integrally formed therein a first handhold opening 12*a* and a dispensing opening 14 immediately below the first handhold opening 12 in accordance to a preferred embodiment of the present invention. The container 10 includes a second handhold opening 12*b* formed therein opposite to the first handhold opening 12*a*. The container 10 comprises opposing top and bottom walls 16*a*, 16*b*, opposite end walls 18*a*, 18*b*, and opposite side walls 20*a*, 20*b*. The opposing top and bottom walls 16*a*, 16*b* are spaced apart from one another by the opposite end walls 18*a*, 18*b* and the opposite side walls 20*a*, 20*b*. The opposing top and bottom walls 16*a*, 16*b* are foldably joined to longitudinal opposite edges of the side walls 20*a*, 20*b*, and the end walls 18*a*, 18*b* are foldably joined to transverse opposite edges of the side walls 20*a*, 20*b*. The top wall panel 16*a* defines by two flap panels 16*a*', 16*a*" and the bottom wall 16*b* defines by two outer flap panels 16*b*', 16*b*" and two inner flap panels 62*a*', 62*a*" as best shown in FIG. 7. The opposing top and bottom walls 16*a*, 16*b*; the opposite end walls 18*a*, 18*b*; and the opposite side walls 20*a*, 20*b* are all cooperating with one another to form the container 10. While this specific embodiment has two side walls 20*a*, 20*b* and two end walls 18*a*, 18*b*, the container 10 of the present invention may have any number of side walls or end walls so long as the container's functions described herein are not compromised.

The first and second handhold openings 12*a*, 12*b* are formed in the respective end walls 18*a*, 18*b*. The handhold openings 12*a*, 12*b* are defined by two adjacent tapered punch-out panels 22*a*, 22*b* that are detachably connected together along a frangible line 23 at the their inner ends and foldably connected at their outer ends 24 to the respective end walls 18*a*, 18*b*. When two adjacent tapered punch-out panels 22*a*, 22*b* are pushed inwardly, they fold oppositely to one another and inwardly into the container 10 in laterally spaced relation to one another on opposite sides of the respective handhold openings 12*a*, 12*b*. The tapered punch-out panels 22*a*, 22*b* form side walls at opposite sides of the each handhold openings 12*a*, 12*b*. A first tear-out panel 25 in the end wall 18*a* adjoins the associated handhold opening 12*a* and when removed forms a dispensing or pourable opening 14 immediately below the associated handhold opening 12*a*.

Figure 2:
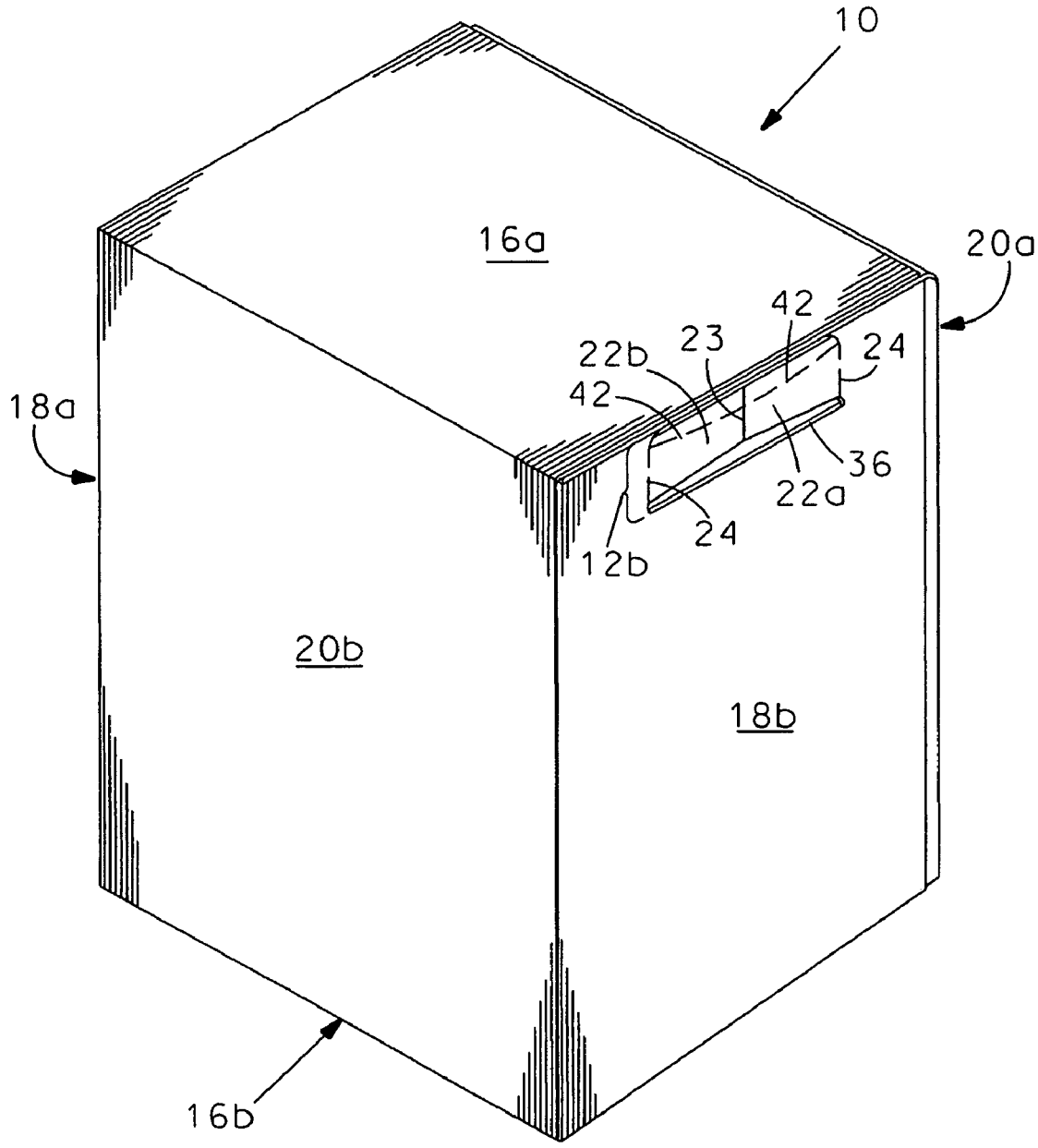
FIG. 2 is similar top perspectives view of the container in FIG. 1 showing an integrally formed therein a second handhold opening opposite to the first handhold opening.

FIG. 2 is similar to FIG. 1, showing an integrally formed therein the second handhold opening 12*b* opposite to the first handhold opening 12*a*. The tapered punch-out panels 22*a*, 22*b* are arranged in a manner such that a user can gain access thereto the handhold openings 12*a*, 12*b* without gaining access to the interior of the container 10 wherein the flowable or pourable substance are stored therein. It should also be noted that the handhold openings 12*a*, 12*b* are formed in a manner that affords a user to grab the container 10 by the handhold openings 12*a*, 12*b* without compromising the interior of the container 10. Accordingly, the handhold openings 12*a*, 12*b* are tamper-resistant that are formed in the end walls 18*a*, 18*b* as shown in FIGS. 1 and 2. The container 10 may contain any number of handhold openings; however, in the preferred embodiment of the present invention, the container 10 includes two handhold openings 12*a*, 12*b*.

Figure 3:
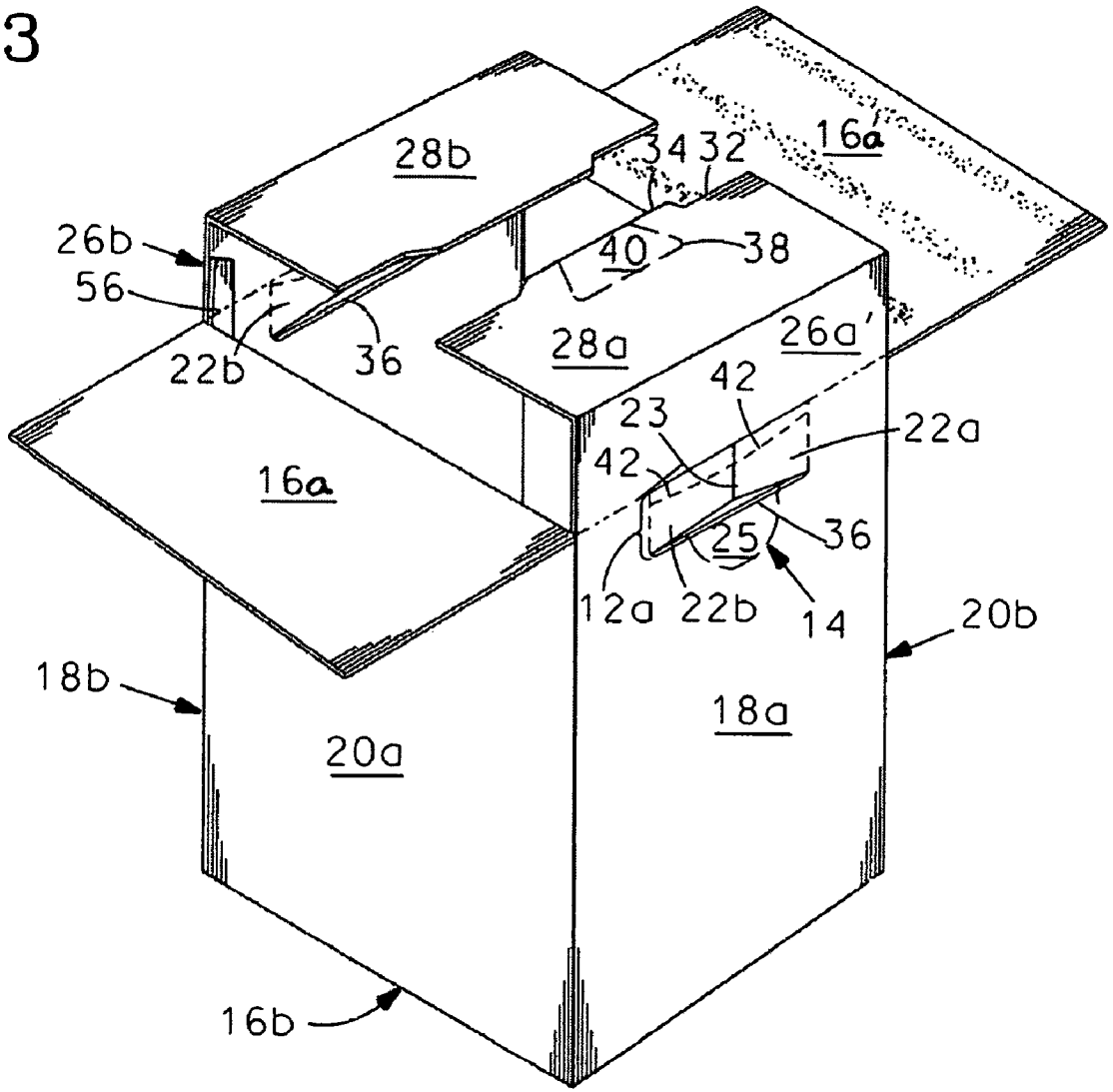
FIG. 3 is a top perspective view of the container in FIG. 1 illustrating the top portion of the container in a partially folded position.
Figure 4:
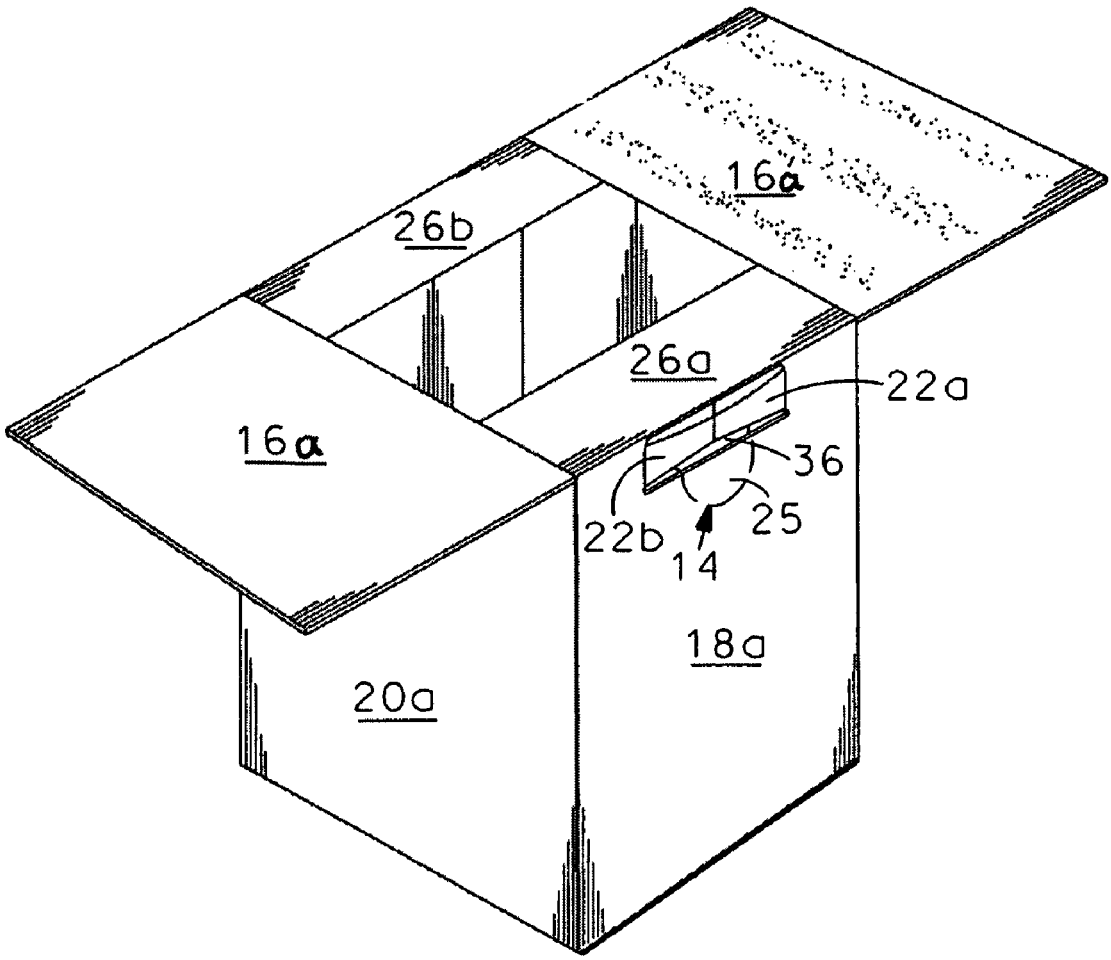
FIG. 4 is the same as container in FIG. 3 illustrating partially closed view of the top portion of the container by a top wall closure.
Figure 5A:
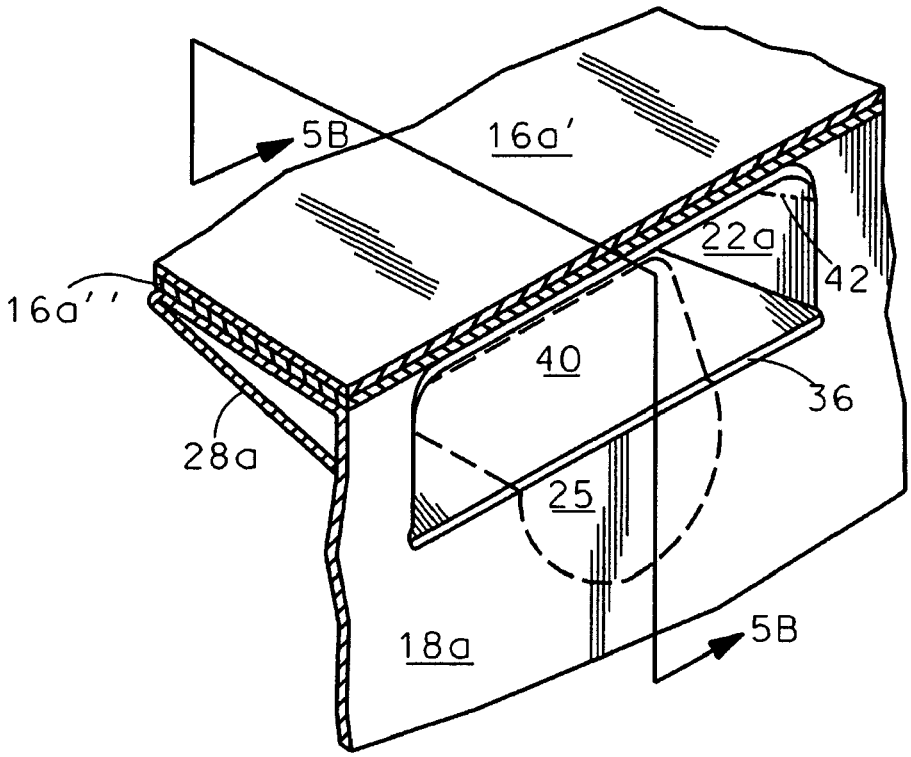
FIG. 5A is an enlarged view of a portion of the container in FIG. 1 showing the first handhold opening in an open position and the dispensing opening in a closed position.
Figure 5B:
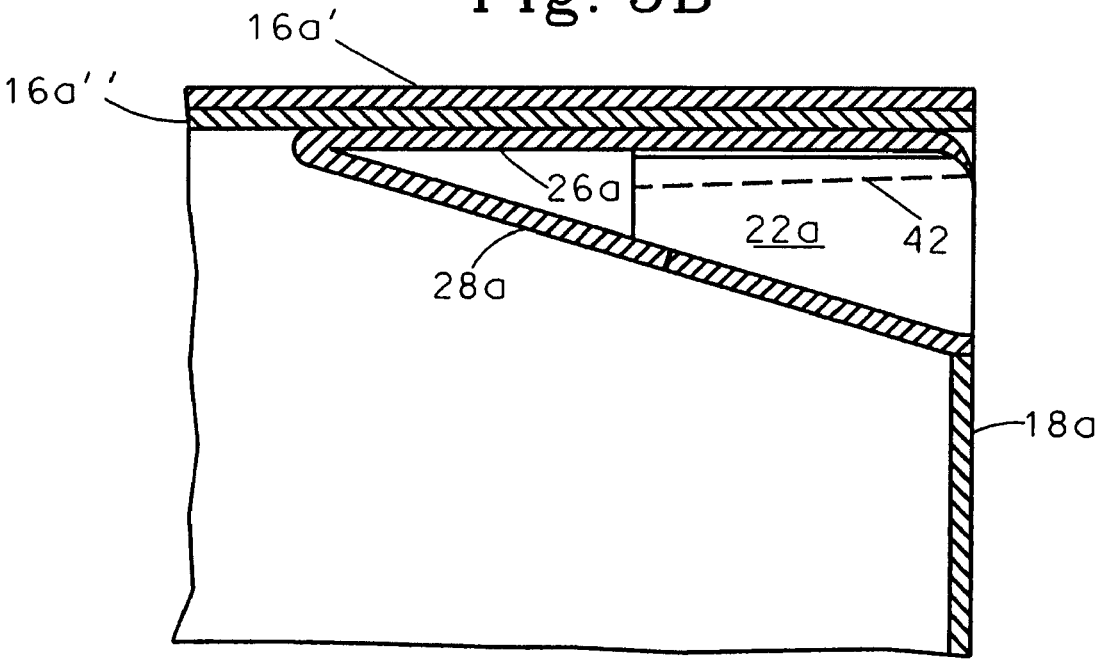
FIG. 5B is an expanded cross-sectional view of the FIG. 5A taken along line 5B-5B.
Figure 5C:
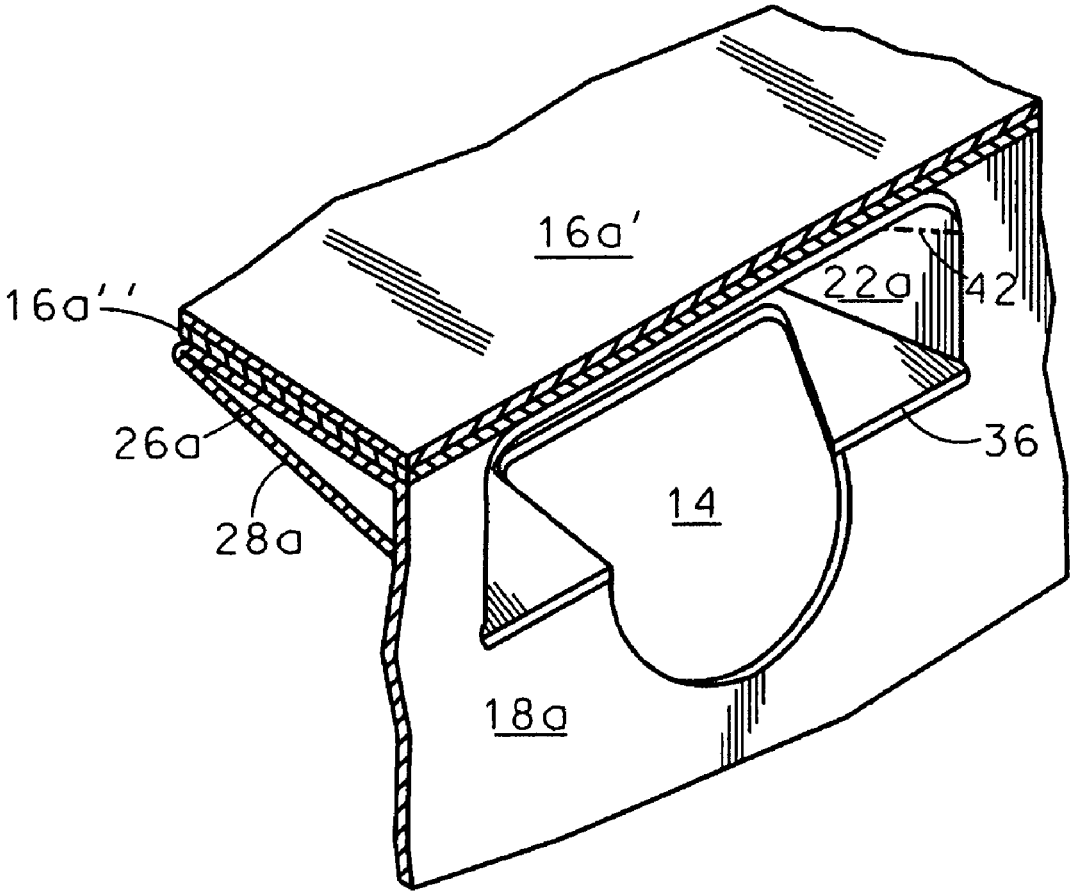
FIG. 5C is the same as FIG. 5A, illustrating the dispensing opening in an open position.

FIGS. 3 and 4 are similar to FIG. 1, illustrating the top portion of the container 10 in a partially folded position. Each of the end walls 18*a*, 18*b* includes a respective pair of first and second flap panels 26*a*', 26*b*' and 28*a*, 28*b*. Each of the respective first flap panels 26*a*', 26*b*' is hinged to the top edge of a respective associated end wall 18*a*, 18*b* and folded inwardly to form a respective partial top closure 26*a*, 26*b* as best shown in FIG. 4. Each of the respective second flap panels 28*a*, 28*b*, also defined as partition panels, is hinged to the respective first flap panels 26*a*', 26*b*' and folded at a downwardly inclined angle back beneath the respective first flap panel 26*a*', 26*b*' so that its free edge 32 lies between the respective handhold openings 12*a*, 12*b* and the respective dispensing opening 26 as best depicted in FIGS. 5A-5C. Each of the angled second flap panels 28*a*, 28*b* extends the full width of the container 10 and defines a partition or shield between the contents of the container 10 and the respective associated handhold openings 12*a*, 12*b*.

A tab 34 on the free edge 32 of the each second flap panels 28*a*, 28*b* is engaged in a slot 36 at the bottom of the respective handhold openings 12*a*, 12*b* to hold the partition or shield panels 28*a*, 28*b* in position. The inwardly folded punch out panels 22*a*, 22*b* that form the handhold openings 12*a*, 12*b* are engaged snugly between the respective pair of first and second flap panels 26*a*', 26*b*' and 28*a*, 28*b*, effecting partial seals at opposite side edges of the handhold openings 12*a*, 12*b*, and with the angled second flap panels 28*a*, 28*b*, prevent leakage of the container 10 contents through the handhold openings 12*a*, 12*b*. A frangible tear line 38 is formed in the free edge of the second flap panels 28*a*, 28*b*. The frangible tear line 38 defines a second tear out panel 40 adjacent the handhold openings 12*a*, 12*b* and can be removed to enlarge the handhold openings 12*a*, 12*b* as best depicted in FIG. 5C.

Referring again to FIGS. 5A-5C, each of the tapered punch-out panels 22*a*, 22*b* includes a score line 42 formed therein to facilitates the panels 22*a*, 22*b* to engage snugly between the first and second flap panels 26*a*', 26*b*' and 28*a*, 28*b* and to prevent the respective second flap panels 28*a*, 28*b* to be pushed upwardly by the content of the container 10 during dispensing of the pourable substance. In addition, it should be noted that when in folded position, the respective second flap panels 28*a*, 28*b* forms a ceiling for the respective handhold openings 12*a*, 12*b*. As one of ordinary skilled in art would appreciates that a second dispensing opening may be located in the container 10, and thus may be partially integrated in the second handhold opening 12*b* similar to that described hereinabove with respect to handhold opening 12*a*. However, in the preferred embodiment of the present invention, as depicted in FIGS. 1 and 2, there is only one dispensing opening 14 formed on the end wall 18*a*. In use, the first tear-out panel 25 is pushed inwardly to open the dispensing opening 14 one may lift and tip the container 10 using, in part, the handhold opening 12*a* in a manner that pours the shipped article from the container 10 through the dispensing opening 14. Accordingly, use of the frangible tear line affords the user of the container 10 the ability to convert the container of the present invention from a tamper-resistant shipping container to a container capable of pouring the contents and/or articles from within.

Figure 6:
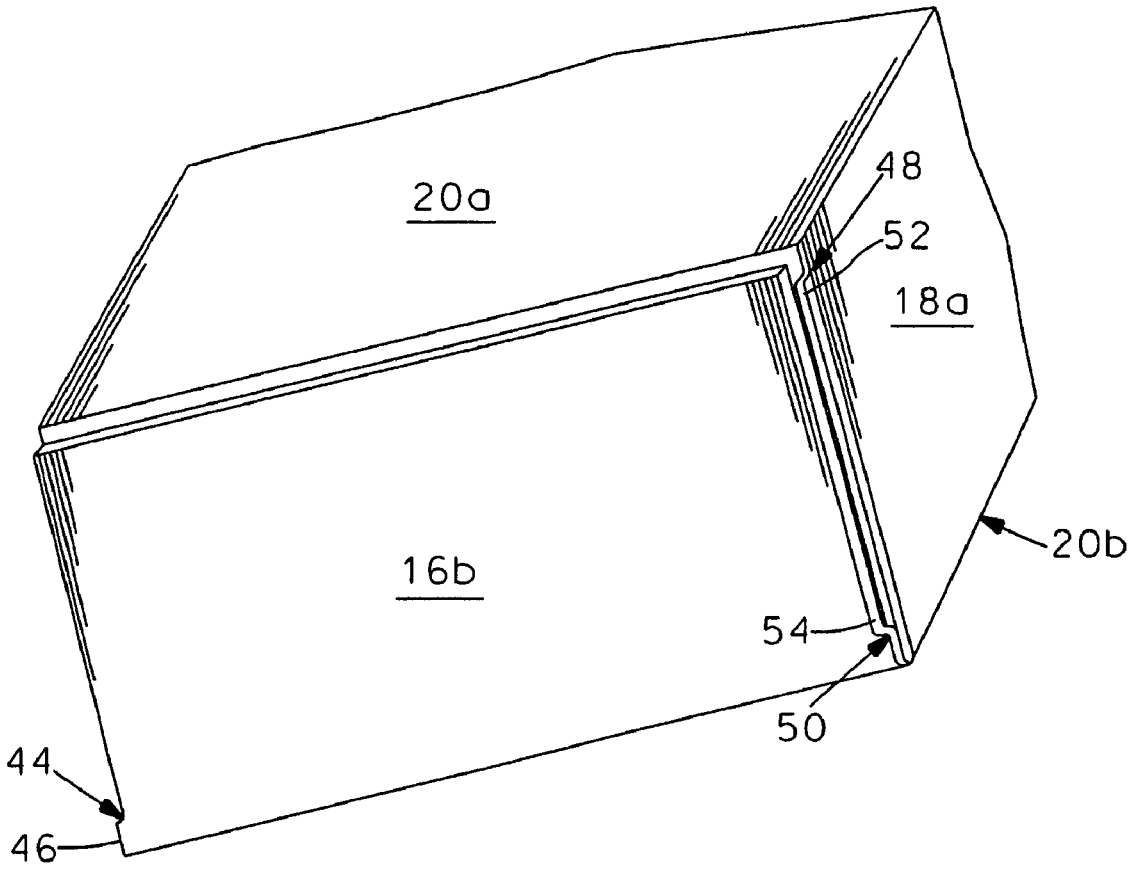
FIG. 6 is a perspective view of a bottom portion of the container shown in FIGS. 1-4.

FIG. 6 is a perspective view of a bottom portion of the container 10 shown in FIG. 1. The bottom wall 16*b* and/or top wall 16*a* may contain at least one leak-resistant feature 44 at the outer edges thereof. The embodiment in FIG. 7 shows one leak-resistant feature 44 that is located at an outer edge of the bottom wall 16*b* and is protruding outwardly therefrom. The leak-resistant feature 44 may be of any feature that is able to reduce leaking of the contents and/or articles from within the container 10, but preferably is a webbed tab 46 that is attached to the bottom wall 16*b*. In addition, FIG. 7 shows respective first and second leak-resistant features 48, 50, wherein the first leak-resistant feature 48 is located at the corner formed by the edges of sidewalls 18*b*, 20*b* and bottom wall 16*b* and the second leak-resistant feature 50 is located at the corner formed by the edges of sidewalls 18*b*, 20*a* and bottom wall 16*b* and protruding outwardly therefrom. Each leak-resistant feature 48, 50 may be any feature that is able to reduce leaking of the contents and/or articles from within the container, but preferably are webbed tabs 52, 54 that are attached to the bottom wall 16*b*.

When fully erected, each webbed tab 48, 52, 54 is compressed so tightly and in a manner to seal any free edge of the container 10 so as to sterically hinder the contents of the container from leaking therefrom these edges. In these embodiments, the leak-resistant features may be located anywhere, but preferably are located at the corners of the container 10 where the edges of the side walls and the edges of the bottom wall meet with one another. While not shown, the same leak-resistant features may be located similarly where the edges of the side walls and the edges of the top wall meet, more preferably the corner where the edge of the top wall 16*a* meets the edges of the side walls 18*a*, 20*b* and/or where the edge of the top wall 16*a* meets the edges of the side walls 18*b*, 20*a*. The leak-resistant features are more prevalent on the bottom of the container 10 because the articles have a greater probability to leak at the corners of the bottom of the container 10.

The container maintains it erected shipping and pouring positions by attaching the walls in any way, preferably gluing the walls together and/or taping the walls together. Also, the walls may contain fastening tabs that are commonly used for hand-erecting, rather than machine erecting. In the exemplified embodiment, the side walls 20*a*, 20*b* and end walls 18*a*, 18*b* are attached to one another by a glue flap 56 as shown in FIG. 3. The container 10 of the present invention may be made from any one or more blanks that are capable of being folded and erected to form the container 10. Accordingly, the present invention also relates to such blanks capable of being erected into the container 10 of the present invention.

FIG. 7 shows one such blank, more specifically, is a plan view of a cut and scored paperboard blank 60 for forming the container 10 in FIG. 1 in accordance to a preferred embodiment of the present invention.

The blank 60 is divided into three sections 64, 66, and 68 by two substantially parallel longitudinal fold lines 70, 72. Section 64 is further divided by cut lines 74, 76, and 78 into four panels, two top wall panels 16*a*', 16*a*" and two panels 26*a*', 26*b*'. In the folded position, the two top wall panels form the top wall 16*a* and the a pair two panels wherein each of which further is divided into respective pair of first and second flap panels 26*a*', 26*b*' and 28*a*, 28*b* by fold lines 82, 84 as depicted in FIG. 3. Section 66 is divided by fold lines 86, 88, 90 into two end walls panels 18*a*', 18*b*' and two side walls panels 20*a*' and 20*b*'. Section 68 is divided into two outer bottom wall panels 16*b*', 16*b*" and two inner bottom wall panels 62*a*', 62*a*". In the folded position, the outer bottom wall panels 16*b*', 16*b*" form the bottom wall 16*b* by folding onto one another into an overlapping relationship and the inner wall panels 62*a*', 62*a*" fold onto one another into an overlapping relationship. The bottom wall flaps 16*b*' foldably joined to bottom edges of said side wall panels 20*a*', 20*b*' wherein adjacent side edges of the bottom wall flaps is separated from one another by a slotted relief cut 92 extending from an outer free edge of the bottom wall flaps 16*b*' to adjacent but spaced from the juncture of the bottom wall flaps 16*b*' with the side wall panels 20*a*', 20*b*', defining a small laterally projecting tab 46 on a side edge of at least one of the bottom wall flaps 16*b*' the juncture 44 as best depicted in FIG. 6.

The top wall flaps 16*a*' are foldably joined to the side wall panels 20*a*', 20*b*' and the first and second flap panels 26*a*', 26*b*' and 28*a*', 28*b*' are subdivided by a transverse fold lines 82, 84 into a top wall partial closure panel 26*a*', 26*b*' and a partition panel 28*a*', 28*b*'. The top wall closure panel 26*a*' is adjacent the associated end wall panel 18*a*', and the partition panel 28*a*', 28*b*' is on the free edge of the top wall partial closure panels 26*a*', 26*b*' and adapted to extend angularly downwardly toward the associated end wall panels 18*a*', 18*b*' and into engagement with a bottom edge of the handhold openings 12*a*', 12*b*' in a container 10 erected from the blank 60 to isolate the handhold openings 12*a*', 12*b*' from the dispensing openings 14.

Figure 7A:
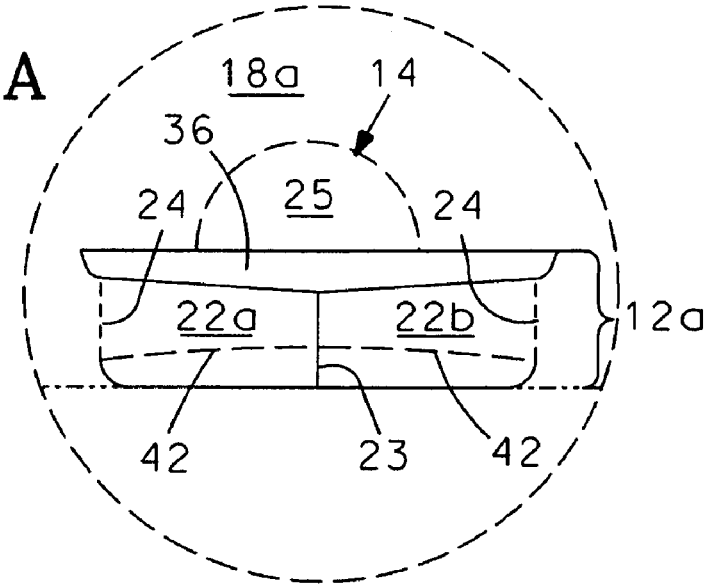
FIGS. 7A, 7B, and 7C are close-up views of a portion of the blank shown in FIG. 7.
Figure 7B:
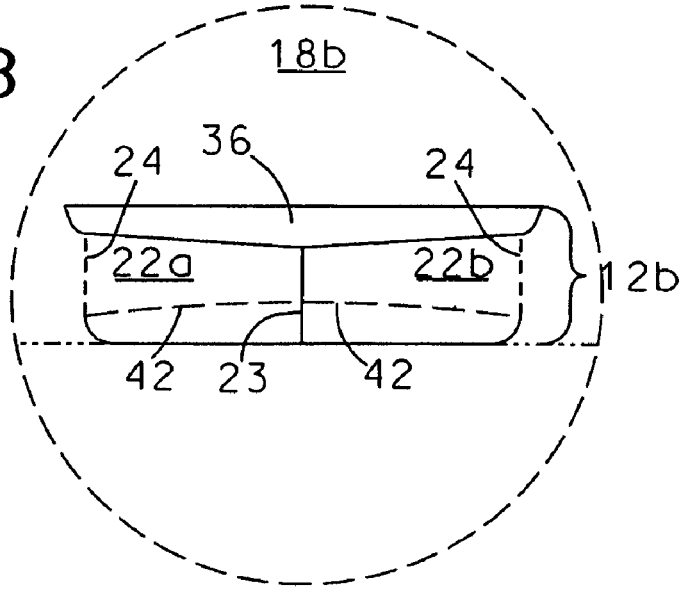
Figure 7C:
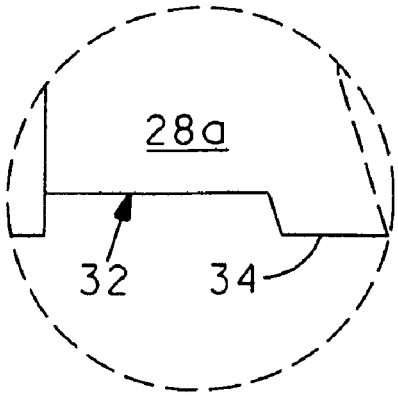

FIGS. 7A, 7B, and 7C depict the enlarged views of a portion of the blank 60 in FIG. 7. In FIGS. 7A and 7B, the handhold openings 12*a*, 12*b* are defined by two adjacent tapered punch-out panels 22*a*, 22*b* that are detachably connected together along a frangible line 23 at the their inner ends and foldably are connected at their outer ends 24 to the respective end walls 18*a*, 18*b*. When two adjacent tapered punch-out panels 22*a*, 22*b* are pushed inwardly, they fold oppositely to one another and inwardly into the container 10 in laterally spaced relation to one another on opposite sides of the respective handhold openings 12*a*, 12*b*. The first tear-out panel 25 in the end wall 18*a* adjoins the associated handhold opening 12*a* and when removed forms the dispensing or pourable opening 14 immediately below the associated handhold opening 12*a* as discussed in detail hereinabove. As shown in FIG. 7C, the tab 34 on the free edge 32 of the each second flap panels 28*a*, 28*b* is engaged in the slot 36 at the bottom of the respective handhold openings 12*a*, 12*b* to hold the second flap panels 28*a*, 28*b*, also defined as partition or shield panels, in position.

Manual set-up of the container 10 is easily accomplished. First, the blank 60 is folded along the fold lines 86, 88, and 90 and then the glue flap 56' is preferably glued to the longitudinal side of the end wall panel 18*b*'. Next, the inner wall panels 62*a*' are folded inwardly with respect to fold line 72 and the bottom wall panels 16*b*' are folded with respect to fold line 72 and glued onto one another in an overlapping relationship to form the bottom wall 16*b* as shown in FIGS. 1-3. Then, the second flap panels 28*a*', 28*b*' are folded with respect to the transverse fold lines 82, 84 toward the interior of the container 10 and folded at a downwardly inclined angle back beneath the respective first flap panel 26*a*', 26*b*' so that the tab 34 lies between the respective handhold openings 12*a*, 12*b* and the respective dispensing opening 14. Each of the angled second flap panels 28*a*, 28*b* extends the full width of the container 10 and defines a partition or shield between the contents of the container 10 and the respective associated handhold openings 12*a*, 12*b*. When the angled second flap panels 28*a*, 28*b* extends the full width of the container 10, the first flap panels 26*a*', 26*b*' form partial top closures 26*a*, 26*b*. Finally, after flowable substance placed in the interior of the container, the pair of flap panels 16*a*' fold onto one another in an overlapping relationship with respect to the fold line 70 and glued thereon to enclose the container 10. When the container 10 is in the closed position, the pair of flap panels 16*b*' which form the top wall 16*b*, rest on the partial top closures 26*a*, 26*b*.

In sum, the present invention is directed to a container for shipping and dispensing flowable substance. The container as described hereinabove comprising a plurality of side walls and bottom wall flaps are foldably joined to bottom edges of the side walls and are folded inwardly therefrom into overlapping relationship with one another to form a bottom wall closure. Top wall flaps are foldably joined to upper edges of the side walls and are folded inwardly therefrom into overlapping relationship with one another to form a top wall closure. Cut lines are formed in an opposed pair of the side walls at respective upper edges thereof, defining first punch-out panels that are pushed inwardly to form handhold openings in the opposed pair of side walls. The top wall flaps adjacent the handhold openings are forming a ceiling for the respective handhold openings. A partition panel is extending angularly downwardly from the top wall flaps to a bottom edge of each the handhold opening to isolate flowable contents of the container from the handhold openings. The partition panels each being folded from the top wall flaps at locations spaced from adjacent the side walls and each having a free edge engaged in the respective handhold opening at a bottom edge thereof to retain the partition panels in position.

Additional cut lines are in one of the side walls of the opposed pair of side walls, adjoining the handhold opening below the free edge of the partition panel, defining a second punch-out panel that is pushed inwardly to form a dispensing opening. The dispensing opening is isolated from the handhold opening by the partition panel. The first punch-out panels each comprise first and second tapered panels connected together along a frangible line at their inner ends and foldably are connected at their outer ends to the respective side wall. The first and second panels are extending between the respective adjacent partition panel and the respective adjacent top wall flaps to form side walls at opposite sides of each of the handhold opening. The first pouch-out panels is also serving to hold the partition panel downwardly against a bottom edge of the handhold openings. A frangible tear line is formed in the free edge of the partition panel adjacent the dispensing opening, defining a tear-out panel in the free edge of the partition panel that can be removed to enlarge the dispensing opening.

The juncture of the two adjoining side walls and associated bottom flaps form a bottom corner, and a small laterally projecting tab is formed on a side edge of at least one of two adjacent bottom wall flaps at the juncture of the bottom wall flaps and associated side walls. The tab is squeezed into the bottom corner to tighten the corner and fill any small space that may otherwise be present at the corner, thereby preventing leakage of flowable substance through the bottom corners of the container.

A blank for making a container 10 for flowable substance comprises a plurality of side wall panels that are foldably joined together along adjacent side edges. A plurality of top wall flaps are foldably joined to top edges of the side wall panels. A plurality of bottom wall flaps are foldably joined to bottom edges of the side wall panels. Adjacent side edges of the bottom wall flaps is separated from one another by a slotted relief cut extending from an outer free edge of the bottom wall flaps to adjacent but spaced from the juncture of the bottom wall flaps with the side wall panels, defining a small laterally projecting tab on a side edge of at least one of the bottom wall flaps at the juncture. Alternatively, the slotted relief cut maybe replaced by a cut line extending from free edge of the bottom wall flaps to the fold line 72.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container for shipping and dispensing flowable substance, comprising:

a plurality of side walls;

bottom wall flaps foldably joined to bottom edges of the side walls and folded inwardly therefrom into overlapping relationship with one another to form a bottom wall closure;

top wall flaps foldably joined to upper edges of the side walls and folded inwardly therefrom into overlapping relationship with one another to form a top wall closure;

respective cut lines in each of a respective opposed pair of the side walls at respective upper edges thereof, defining respective first punch-out panels that are pushed inwardly to form respective first and second handhold openings in the respective opposed pair of side walls;

the top wall flaps adjacent the respective first and second handhold openings forming a ceiling for the respective first and second handhold openings; and respective first and second partition panels extending angularly downwardly from the respective top wall flaps to a bottom edge of each of the respective first and second handhold opening to isolate flowable contents of the container from the respective first and second handhold openings, the respective first and second partition panels each being folded angularly with respect to the respective top wall flaps and each of the respective first and second partition panels having a free edge engaged in the respective first and second handhold openings at a bottom edge thereof to retain the respective first and second partition panels in position.

2. The container of claim 1, wherein:

additional cut lines are in one of the opposed pair of side walls, adjoining the first handhold opening below the free edge of the first partition panel, defining a second punch-out panel that is pushed inwardly to form a dispensing opening, the dispensing opening being isolated from the first handhold opening by the first partition panel.

3. The container of claim 1, wherein:

the respective first punch-out panels each comprise first and second tapered panels connected together along a frangible line at their inner ends and foldably connected at their outer ends to the respective opposed pair of side walls, the first and second tapered panels extending inwardly between the respective adjacent first and second partition panel and the respective adjacent top wall flaps to form side walls at opposite sides of each of the first and second handhold openings, the respective first pouch-out panels also serving to hold the respective first and second partition panels downwardly against the bottom edge of the first and second handhold openings.

4. The container of claim 2, wherein:

a frangible tear line is formed in the free edge of the first partition panel adjacent the dispensing opening, defining a tear-out panel in the free edge of the first partition panel that can be removed to enlarge the dispensing opening.

5. The container of claim 1, wherein:

a frangible tear line is formed in the free edge of the second partition panel.

6. A container as claimed in claim 1, wherein:

a juncture of the plurality of side walls and respective associated bottom flaps form a bottom corner, and a small laterally projecting tab is formed on a side edge of the at least one of the bottom wall flaps at the juncture of the bottom wall flaps and the associated plurality of side walls, the small laterally projecting tab being squeezed into the bottom corner to tighten the corner and fill any small space that may otherwise be present at the corner, thereby preventing leakage of flowable substance through the bottom corners of the container.

7. A container for flowable substance, comprising:

an opposed pair of end walls and opposed pair of side walls;

first top wall flaps each of which foldably joined to upper edge of the respective opposed pair of side walls and folded inwardly therefrom to form a top wall closure and second top wall flaps each of which foldably joined to upper edge of the opposed pair of end walls;

bottom wall flaps foldably joined to bottom edges of the opposed pair of side walls and opposed pair of end walls and folded inwardly therefrom to form a bottom wall closure, the two adjacent side wall and end wall and the associated bottom wall flaps forming a bottom corner;

cut lines in the opposed pair of the end walls at respective upper edges thereof, defining respective first punch-out panels that are pushed inwardly to form respective first and second handhold openings in the opposed pair of end walls and wherein additional cut lines being formed adjoining the first handhold opening, defining a second punch-out panel that is pushed inwardly to form a dispensing opening;

first and second partition panels extending angularly downwardly from the respective second top wall flaps to a bottom edge of each of the respective first and second handhold opening to isolate flowable contents of the container from the respective first and second handhold openings and wherein the dispensing opening being isolated from the first handhold opening by the first partition panel; and a small laterally projecting tab on a side edge of the at least one of two bottom wall flaps at a juncture of the bottom wall flaps and associated side walls and end walls, the small laterally projecting tab being squeezed into the bottom corner to tighten the corner and fill any small space that may otherwise be present at the corner, thereby preventing leakage of flowable substance through the bottom corners of the container.

8. A blank for making a container for flowable substance, comprising:

a plurality of side wall panels foldably joined together along adjacent side edges;

a plurality of top wall flaps foldably joined to top edges of the side wall panels;

a plurality of bottom wall flaps foldably joined to bottom edges of the side wall panels, adjacent side edges of the bottom wall flaps being separated from one another by a slotted relief cut extending from an outer free edge of the bottom wall flaps to adjacent but spaced from the juncture of the bottom wall flaps with the side wall panels, defining a small laterally projecting tab on a side edge of at least one of the bottom wall flaps at the juncture;

cut lines in two of the side walls adapted to be in opposed relationship with one another in a container erected from the blank define first punch-out panels that can be pushed inwardly to form hand hold openings in the two side walls in a container erected from the blank;

the top wall flaps adjacent the handhold openings form a ceiling for the respective handhold openings in a container erected from the blank;

additional cut lines in at least one of the two side walls define a second punch-out panel that can be removed to form a dispensing opening in a container erected from the blank and wherein the second punch-out panel being contiguous to the first punch-out panels; and the top wall flaps joined to the side wall panels having the first and second punch-out panels are each subdivided by a transverse fold into a top wall panel and a partition panel, each of the top wall panels being adjacent the associated side wall panel, and the partition panel being on the free edge of the top wall panel and adapted to extend angularly downwardly toward the associated side wall panel and into engagement with a bottom edge of the respective handhold opening in a container erected from the blank to isolate the respective handhold opening from the contents.

9. A blank for making a container for flowable substance, comprising:

a plurality of side wall panels foldably joined together along adjacent side edges, the plurality of side wall panels including first side wall panels that are adapted to be disposed in opposed relationship to one another in a container erected from the blank;

a plurality of bottom wall flap panels foldably joined to bottom edges of the side wall panels, the bottom wall flap panels adapted to be folded inwardly to form a bottom wall closure in a container erected from the blank;

a plurality of top wall flap panels foldably joined to upper edges of the side wall panels, the plurality of top wall flap panels including first top wall flap panels foldably attached to the first side wall panels;

first cut lines in the first side wall panels at respective upper edges thereof, defining first punch-out panels that can be pushed inwardly to form respective first and second handhold openings in the first side wall panels; and the first top wall flap panels divided by a transverse fold line into a top wall panel and a partition panel, each of the top wall panels forming a ceiling for the respective first and second handhold openings in a container erected from the blank, and the partition panel adapted to extend angularly downwardly to a bottom edge of one of the respective first and second handhold openings in a container erected from the blank.

10. The blank of claim 9, wherein:

additional cut lines are in one of the first side wall panels, adjoining the first cut lines, defining a dispensing opening punch-out panel contiguous with the first punch-out panels.

* * * * *